US006422729B1

(12) United States Patent
Rohrbach et al.

(10) Patent No.: US 6,422,729 B1
(45) Date of Patent: Jul. 23, 2002

(54) METHOD AND APPARATUS FOR DEHYDRATING A VEHICLE LAMP HOUSING

(75) Inventors: Ronald Paul Rohrbach, Flemngton, NJ (US); Gordon William Jones, Toledo, OH (US); Peter Unger, Convent Station; Daniel Bause, Flanders, both of NJ (US); Gary Zulauf, Findlay, OH (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/492,428

(22) Filed: Jan. 27, 2000

(51) Int. Cl.[7] ..... F21W 101/10; F21V 29/00
(52) U.S. Cl. ..... 362/547; 362/539
(58) Field of Search ..... 362/297, 539, 362/547

(56) References Cited

U.S. PATENT DOCUMENTS

| | | | | | |
|---|---|---|---|---|---|
| 3,553,519 | A | | 1/1971 | Hicks | 313/113 |
| 4,612,607 | A | | 9/1986 | Seqoshi et al. | 362/267 |
| 4,722,039 | A | | 1/1988 | Gaugel | 362/296 |
| 4,731,709 | A | | 3/1988 | Freudenreich et al. | 362/80 |
| 4,739,458 | A | | 4/1988 | Yamayoshi et al. | 362/294 |
| 4,750,093 | A | * | 6/1988 | Bals et al. | 362/547 |
| 4,755,917 | A | | 7/1988 | Bals et al. | 362/267 |
| 4,796,163 | A | * | 1/1989 | Dressler | 362/547 |
| 4,809,144 | A | | 2/1989 | Suzuki | 362/547 |
| 5,057,368 | A | | 10/1991 | Largman et al. | 428/397 |
| 5,253,153 | A | | 10/1993 | Mathews et al. | 362/310 |
| 5,406,467 | A | | 4/1995 | Hashemi | 362/547 X |
| 5,457,616 | A | | 10/1995 | Grigorescu et al. | 362/294 |
| 5,660,462 | A | | 8/1997 | Bockley et al. | 362/256 |
| 5,702,178 | A | | 12/1997 | Smith et al. | 362/294 |
| 5,704,966 | A | | 1/1998 | Rohrbach et al. | 95/170 |
| 5,850,124 | A | | 12/1998 | Hasegawa et al. | 313/578 |

* cited by examiner

*Primary Examiner*—Laura K. Tso

(57) ABSTRACT

A regenerable desiccant filter assembly, for use in a vehicle lamp housing, includes a hollow body defining a chamber therein, the hollow body having an inlet and an outlet formed therein to allow air to flow from an area outside said hollow body into and through the hollow body. A substrate, which is a nonwoven fiber mat, is housed within the hollow body; and a regenerable liquid desiccant composition is distributed on the substrate. Preferably, the fibers making up the substrate have hollow internal cavities formed therein, and extended openings formed in the sides thereof in communication with the internal cavities. Preferably, the desiccant composition is an alkali halide or an alkaline earth halide. Most preferably the desiccant composition is selected from the group consisting of lithium chloride, calcium chloride and magnesium chloride. In specific embodiments, the desiccant filter may be combined with a bulb shield or with a bulb socket member. A method of dehydrating air flowing into a ventilation opening in a vehicle lamp housing, using the inventive apparatus, is also disclosed.

22 Claims, 9 Drawing Sheets

METHOD AND APPARATUS FOR DEHYDRATING A VEHICLE LAMP HOUSING

BACKGROUND OF THE INVENTION

1. Field of the invention

The present invention relates to a method and apparatus for removing moisture from ambient air as it moves into, or out of, a vehicle lamp housing. More particularly, the present invention relates to such a method and apparatus in which a filtering fiber mat, containing a regenerable desiccant material, is contained within a filter housing, which can be placed in fluid communication with a vent passage of a vehicle lamp housing.

2. Description of the Background Art

In the automotive industry, high humidity within isolated vented vehicle lamp housings, leading to water condensation on the inner surfaces of the lamp housings, poses a recurring problem in certain vehicles. While not a widespread problem, this problem is recurrent enough to cause some concern. It is believed that this situation is caused by the following conditions.

First, during operation of a vehicle lamp such as, for example, a headlamp, of a type which is disposed within a lamp housing that is vented to air outside the unit, the heat of the bulb causes expansion of the air inside of the lamp housing, forcing the heated air outwardly from the housing through one or more vent tubes or openings therein. This expulsion of air from the housing results in less air mass being present in the housing, after a period of operation, than was present when the lamp was cold.

Later, when the vehicle is parked and the lamp is turned off, the ambient temperature inside of the lamp housing gradually cools, and the air left in the housing contracts, thereby lowering the pressure inside the housing and drawing fresh external air into the housing through the vent(s).

When conditions outside the lamp housing include a high level of humidity, the replacement air drawn into the housing is humid air, which may contain tiny suspended water droplets and/or evaporated water in the gas phase. As the lamp housing continues to cool, moisture, from humid air which has been newly drawn into the lamp housing, may precipitate and condense out of the air to form liquid water, and such water may be deposited on the internal surfaces of the housing.

Once a high level of moisture becomes established inside of a lamp housing, it may persist and be difficult to get rid of, because the vent hole or holes are relatively small, and turning the lamp back on may cause re-evaporation of liquid condensate within the housing. A cycle of condensation and evaporation inside the lamp housing may follow, without significantly reducing the humidity level therein. Repetitive cycles of evaporation and condensation, under the above-described conditions, may actually exacerbate the problem and promote deterioration of electrical components of the lamp.

Moisture buildup in headlamp assemblies results in customer dissatisfaction and an expensive replacement of the entire lamp assembly. Such condensation can occur immediately following production or can show up much later in the useful life of the vehicle.

There is a trend in the automotive industry to mount the vehicle headlamp in an enclosed plastic headlamp assembly. A halogen or tungsten lamp is mounted within a plastic assembly, which contains the reflector, lens, positioning mechanism, and lamp fixture. In addition, there has been a trend toward the use of clear plastic lenses, without texture or embossing, in such headlamp assemblies. Moisture buildup becomes much more obvious with this type of lens.

Some efforts have been made in the art to overcome the aforementioned problem. Many different types of designs are known for lamp housings having particular designs for ventilator ports or tubes formed therein, such as those disclosed in U.S. Pat. No. 5,457,616 and 5,702,178.

U.S. Pat. No. 5,406,467 discloses a ventilation system for a vehicle lamp in which a baffle is placed inside of a rubber hose serving as a ventilation tube, and a porous filter plug is placed inside the tube at the top of the baffle, to try and minimize the amount of liquid water which may enter into the lamp housing.

Some designs are also known for placing desiccant materials inside of lamp housings, which may be done in conjunction with ventilation tubes. Examples of these types of desiccant apparatus are given by U.S. Pat. Nos. 4,612,607, 4,731,709, 4,739,458, 4,755,917, and 4,809,144.

U.S. Pat. No. 4,755,917 generically suggests using a granular, reversibly-acting hygroscopic desiccating agent in a ventilation flow housing of a vehicle lamp. However, this reference fails to specifically mention any particular desiccating agent or agents which are usable in connection therewith. This same reference also suggests that a duct, filled with a desiccating agent, may be located in a hood disposed in the path of a light beam from an incandescent bulb of a headlight. The reference does not depict, illustrate or give any specific information as to how to arrange the duct containing the desiccant material with respect to such a hood.

Several patents exist relating to bulb shields to cover the intense light exiting directly from a vehicle lamp. Some examples of such bulb shield designs are disclosed in U.S. Pat. Nos. 3,553,519, 4,722,039, 5,253,153, 5,660,462, and 5,850,124.

The assignee of the present invention has invented a type of wicking fiber material, which is useful in a variety of applications. These fibers are disclosed in U.S. Pat. No. 5,057,368 to Largman et al.

A need still exists in the art for an improved dehydrating method and filter apparatus for placement in fluid communication with the vent opening of a lamp housing, to filter air as it enters and leaves the housing, and to minimize the amount of water allowed into and retained within the housing. Preferably, the desiccant used in such a filter apparatus would be capable of being regenerated, so that it could use the natural heating and cooling cycle of the lamp to regenerate the desiccant material, and would therefore be usable throughout an extended life through repeated heating and cooling cycles of the lamp.

SUMMARY OF THE INVENTION

The present invention provides a regenerable desiccant filter assembly for use in a vehicle lamp housing. The present invention also provides a method of dehydrating air flowing through a ventilation opening in a vehicle lamp housing, using the inventive apparatus.

A filter assembly in accordance with the present invention, generally, includes: a) a hollow body defining a chamber therein, the hollow body having an inlet and an outlet formed therein to allow air to flow from an area outside of the hollow body into and through the hollow body; b) a substrate housed within the hollow body; and c) a desiccant composition distributed on the substrate.

The hollow body may be a tubular member, which may have a single inlet and a single outlet covered by water-resistant screen members, or may be a foraminous member. In one embodiment, the hollow body may be combined with a bulb shield for a vehiclular bulb. In another embodiment, the hollow body may be an integral part of a bulb socket housing.

Preferably, the substrate is a non-woven fiber material which has hollow internal cavities formed therein, and extended openings formed in the sides thereof, in which the internal cavities communicate with the outside environment through the extended openings.

In a fixed bed format, the present invention provides a liquid desiccant with superior water removal properties as compared to solid granular desiccants.

Also preferably, the desiccant composition is an alkali halide or an alkaline earth halide. Most preferably the desiccant composition is selected from the group consisting of lithium chloride, calcium chloride and magnesium chloride.

Accordingly, it is an object of the present invention to provide a method and apparatus for reducing the humidity of air passing through a ventilation opening of a vehicle lamp housing.

It is a further object of the present invention to provide an improved method and apparatus for reducing the humidity of air within a lamp housing.

It is yet a further object of the present invention to provide an improved method and apparatus for reducing air humidity, which involves the use of a regenerable desiccant material.

It is a still further object of the present invention to provide a method and apparatus of the type described which will be operable after a temperature reduction of only a few degrees from an operating temperature within a lamp housing.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENT

Figure 1:
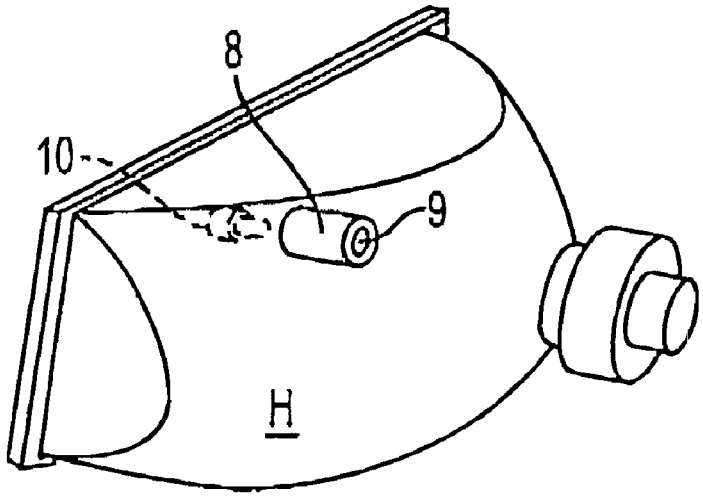
FIG. 1 is an exploded perspective view of a headlamp housing with a filter assembly in accordance with a first embodiment of the present invention shown in phantom therein.

Referring now to FIG. 1, a headlamp housing H is shown having an integral ventilation tube 8 formed therein. The ventilation tube 8 has a hollow vent passage 9 formed therethrough, to allow automatic pressure equalization between the air inside and outside of the housing H.

Figure 2:
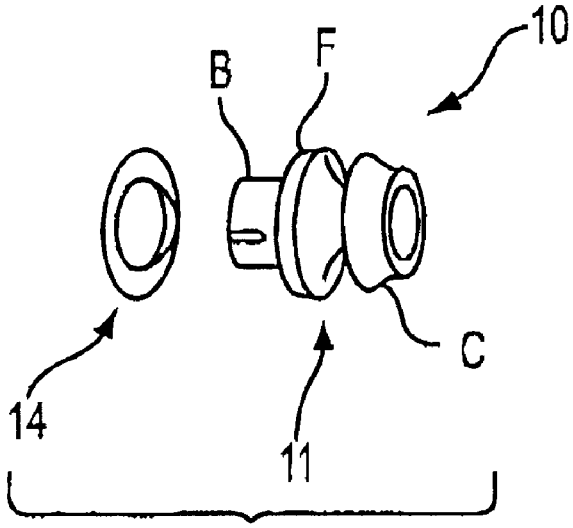
FIG. 2 is an enlarged perspective view of the filter assembly of FIG. 1.
Figure 3:
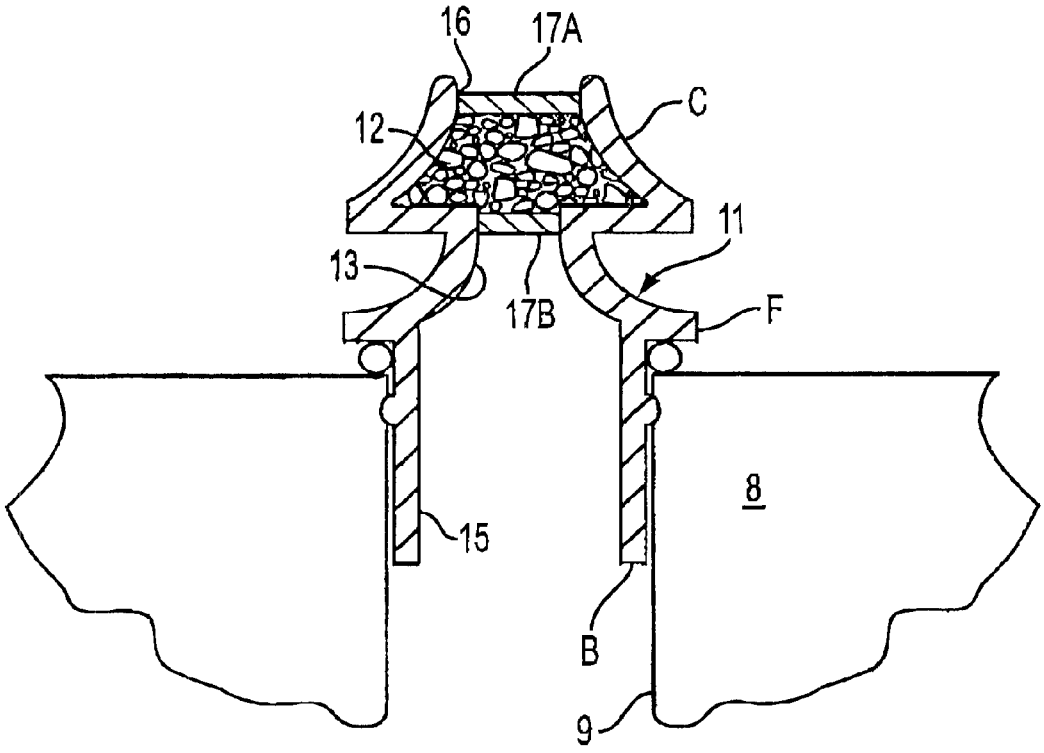
FIG. 3 is a cross-section of the filter assembly of FIGS. 1–2.

The present invention provides an improved dehydrating filter 10 for placement inside of the housing H in fluid communication with the vent passage 9 thereof Referring to FIGS. 2–3, a filter apparatus in accordance with a first embodiment of the invention is shown generally at 10. The filter apparatus 10 includes a hollow body 11, a fiber mat 12 disposed within a chamber 13 inside the hollow body, and an O-ring seal 14.

THE HOLLOW BODY (First Embodiment)

The hollow filter body 11 is preferably formed of a chemical-resistant and heat tolerant plastic material. The hollow body 11 includes a base B at a first end thereof, for interfering placement inside of the vent passage 9 of the headlamp housing H. The hollow body 11 also includes a transverse flange F which extends substantially perpindicularly outwardly thereon, adjacent the base B, to provide a stop means for limiting the extent of insertion of the hollow body 11 into the passage 9. The hollow body 11 also includes a container portion C at a second end thereof, opposite the base B, for containing the filter mat 12.

The hollow body 11 has a first opening 15 formed in the base B thereof, for placement within the vent passage 9 to allow ambient air to flow into the filter 10 from outside. The hollow body 11 also has a second opening 16 formed therein for placement within the headlamp housing H, facing away from the vent passage 9 opposite the first opening 15, to allow fluid communication between air within the lamp housing H and the filter 10.

Preferably, and as seen in FIG. 3, the hollow body 11 has first and second foraminous screen panels 17A, 17B disposed transversely across the chamber 13 on opposite sides of the fiber mat 12 to help keep it in place.

Where used, the screen panels 17A, 17B are preferably formed of a material which is resistant to the passage of water vapor therethrough, such as, for example, the material sold commercially by the W. L. Gore company under the trademark GORE-TEX.

Alternatively, the fiber mat 12 may be placed into the chamber 13 without the screen panels 17A, 17B.

Figure 4:
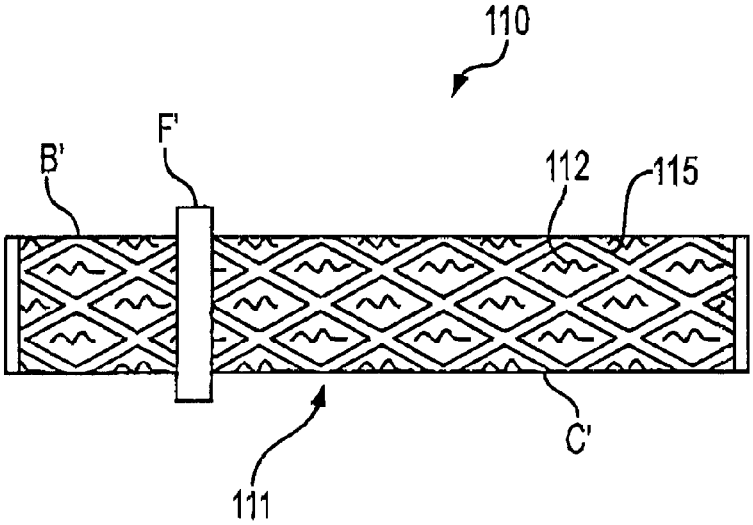
FIG. 4 is a side plan view of a filter assembly in accordance with a second embodiment of the present invention.

Referring now to FIG. 4, a second embodiment of a filter in accordance with the present invention is shown generally at 110. The filter apparatus 110 includes a hollow body 111 and a fiber mat 112 disposed within a chamber 113 inside the hollow body.

THE HOLLOW BODY (Second Embodiment)

The hollow filter body is 111 preferably formed of a chemical-resistant and heat tolerant plastic material. One suitable material is the thermoplastic material based on a polymer of formaldehyde which is referred to generically as acetal.

The hollow body 111 in this embodiment is generally cylindrical in shape, and includes a base B' at a first end thereof, for interfering placement inside of the vent passage 9 of the headlamp housing H. The hollow body 111 also includes a transverse flange F' which extends substantially perpindicularly outwardly thereon, adjacent the base B', to provide a stop means for limiting the extent of insertion of the hollow body 111 into the passage 9. The hollow body 111 also includes a container portion C' at a second end thereof, opposite the base B', for containing the fiber mat 112.

The hollow body 111 is constructed as a screen-like foraminous member, with a plurality of openings 115 formed therein.

SHIELD/FILTER ASSEMBLY (1)

Figure 9:
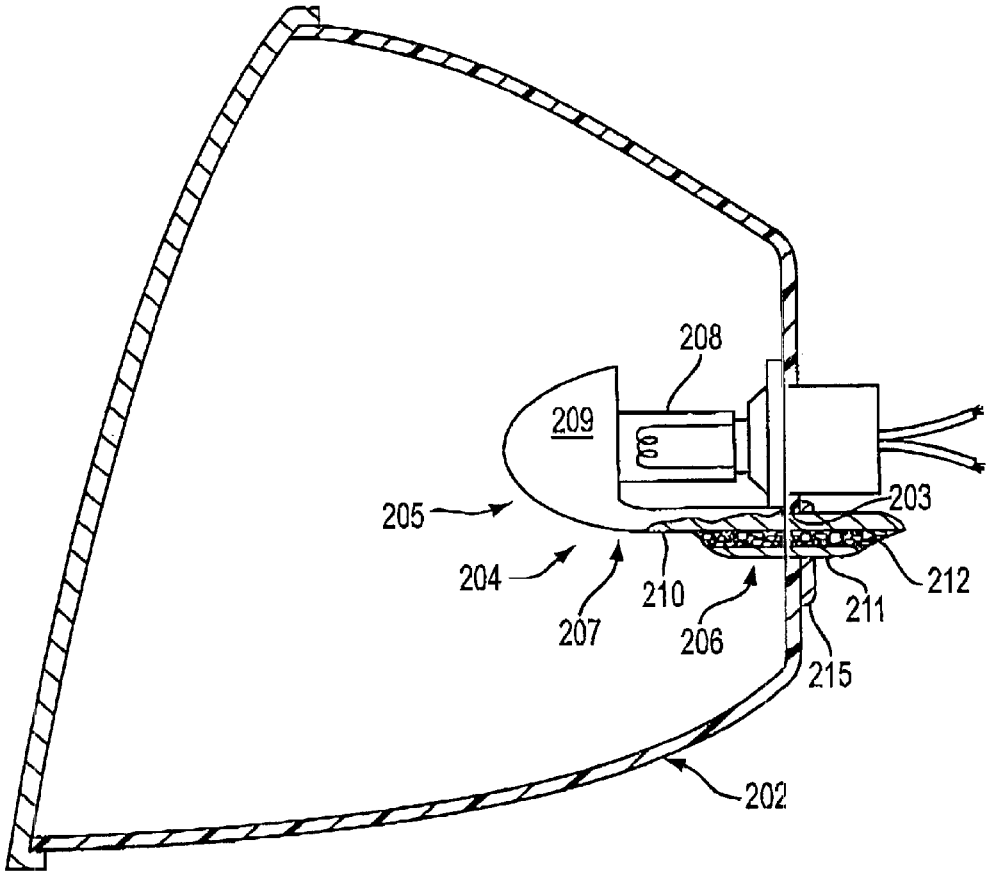
FIG. 9 is a partial cross section and a partial side plan view of a headlamp housing containing a third embodiment of the invention, wherein a desiccant filter is combined with a lamp shield in a first shield/filter assembly.
Figure 10:
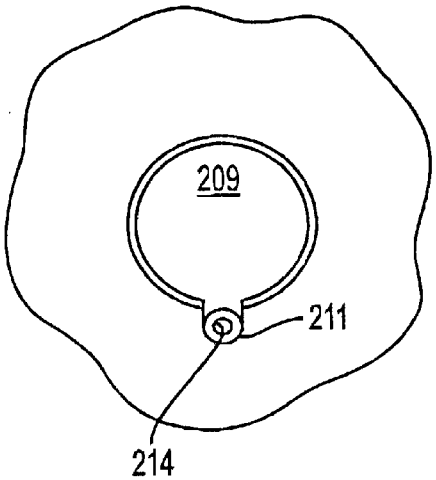
FIG. 10 is a rear plan view of the combination desiccant filter/lamp shield of FIG. 9.

Referring now to FIGS. 9–10, a third embodiment of the present invention is shown installed in its operative configuration on a lamp housing 202 having an integral vent passage 203 formed therein. This third embodiment of the invention is provided as a combined shield/filter assembly 204 including both a headlamp shield 205 and a dehydrating filter 206. The assembly 204 includes a solid body member 207, and a nonwoven fiber mat 212 disposed therein, in a manner to be described below. The body member 207 may be made of plastic, ceramic, or other appropriate material known in the art, but where plastic is used, the material should be heat tolerant because of the heat generated during extended operation of the bulb 208.

The shield 205 includes a hollow, concave, generally parabolic domed hood 209 with an integral stem 210 supportively connected to one side thereof The shield/filter assembly 204 further includes a hollow sleeve 211 integrally attached to the stem 210 opposite the hood 209. The sleeve 211 has a cylindrical passage 214 formed therethrough. The amorphous nonwoven fiber mat 212 is disposed in the passage 214 of the sleeve 211. The fiber mat 212 is impregnated with a liquid desiccant, in a substantially similar fashion to that described herein in connection with the fiber mat 12 of the first embodiment.

When the sleeve 211 of the assembly 204 is inserted through the vent passage 203, the hood 209 is placed in covering relation to the high-intensity bulb 208, so that light emitted therefrom is diffused and reflected before exiting the housing 202. A "pal nut" or other appropriate fastener 215 is placed surrounding the sleeve 211 at the exterior of the housing 202, to retain the assembly 204 in fixed relation to the housing 202.

SHIELD/FILTER ASSEMBLY (2)

Figure 11:
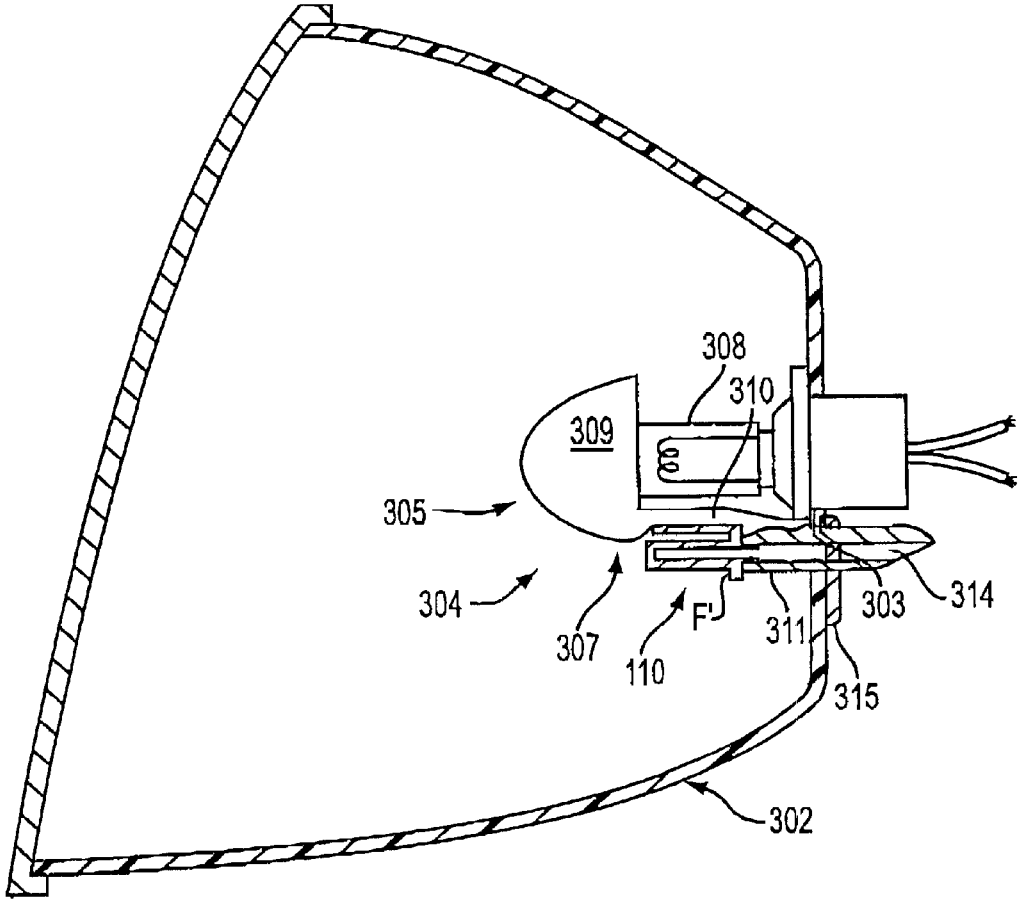
FIG. 11 is a partial cross section and a partial side plan view of a headlamp housing containing a fourth embodiment of the invention, wherein a desiccant filter is combined with a lamp shield in a second shield/filter assembly.
Figure 12:
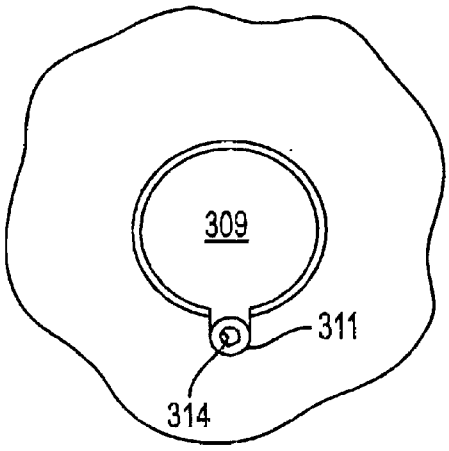
FIG. 12 is a rear plan view of the combination desiccant filter/lamp shield of FIG. 11.
Figure 13:
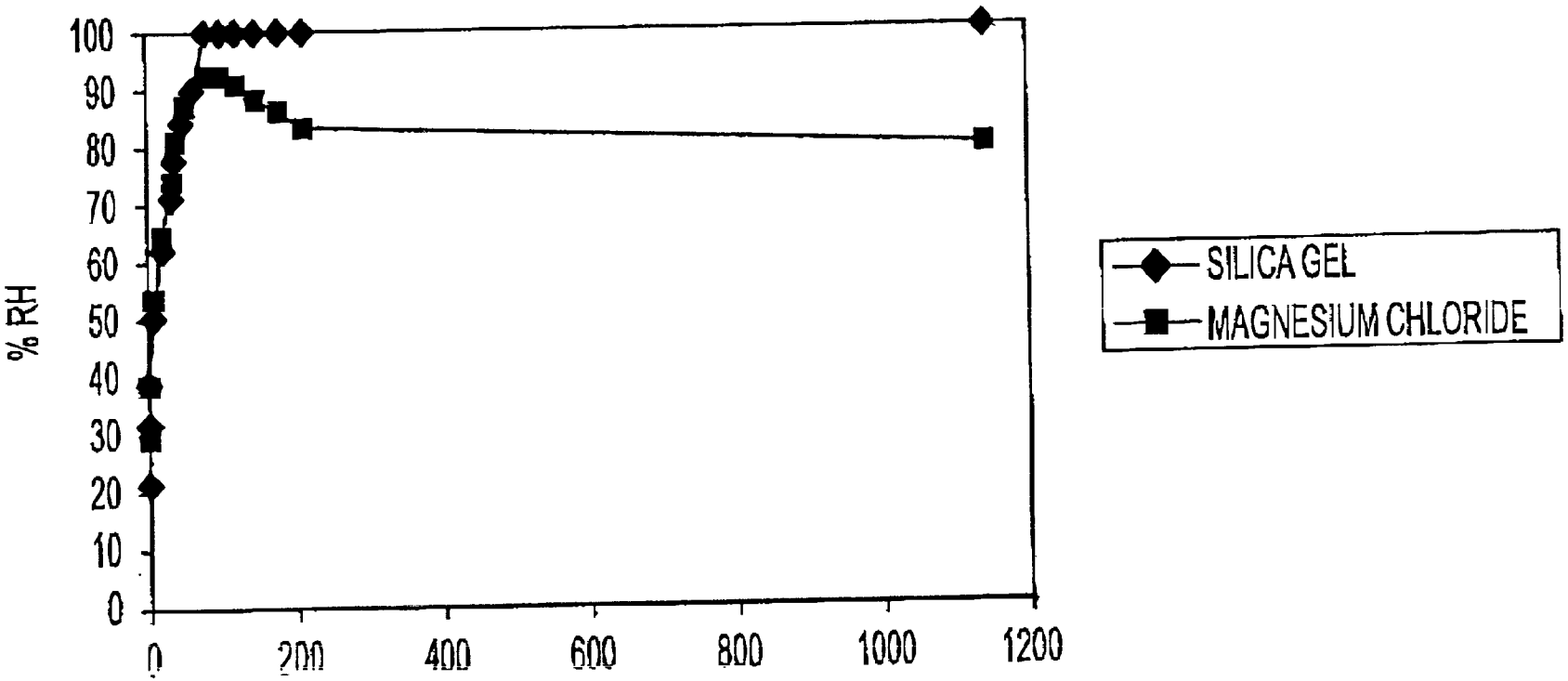
FIG. 13 is a comparative graph of the performance of a desiccant filter according to the invention compared to the performance of a desiccant filter using solid silica gel in a 100% relative humidity environment.

Referring now to FIGS. 11–12, another embodiment of a combined shield/filter assembly is shown at 304. This assembly 304 shares many features of the shield/filter assembly 204 discussed above, but is modified therefrom to incorporate the filter 110 according to the second embodiment of the invention, as depicted in FIG. 4 and discussed above in connection therewith. The shield/filter assembly 304 in this embodiment consists primarily of a body member 307, and a desiccant filter 110 inserted thereinto.

In FIG. 11, the shield/filter assembly 304 is shown installed in its operative configuration on a lamp housing 302 having an integral vent passage 303 formed therein. The lamp housing 302 is substantially identical to the lamp housing 202 discussed in connection with the third embodiment. The lamp housing 302, per se, does not form a part of the present invention, but rather provides an environment in which the invention functions.

This fourth embodiment of the invention is provided as a combined shield/filter assembly 304 including both a headlamp shield 305 and a dehydrating filter 110.

The assembly 304 includes a solid body member 307, which may be made of plastic, ceramic, or other appropriate material known in the art. Where plastic is used, the material should be heat tolerant because of the heat generated during extended operation of the bulb 308.

The shield 305 includes a hollow, concave generally parabolic domed hood 309 with an integral stem 310 supportively connected to one side thereof The shield/filter assembly 304 further includes a hollow sleeve 311 integrally attached to the stem 310 opposite the hood 309. The sleeve 311 has a cylindrical passage 314 formed therethrough, and the base B' of the filter 110 fits interferingly within the passage 214, as shown.

The primary difference between the shield/filter assembly 304 in this embodiment and the shield/filter assembly 204 in the embodiment of FIGS. 9–10 is that here, there is no fiber mat disposed within the passage 314 of the sleeve 311, but instead, the filter 110 is a separate member which contains the fiber mat 112 therein, and which is disengageable from the body member 307. The stem 310 in this embodiment is constructed and arranged to provide enough space for the filter 110 to fit in close proximity thereto, and the innermost portion of the sleeve 311, in this embodiment, has a flattened transverse face to provide an engaging surface which abuttingly engages the flange F' of the filter 110.

When the sleeve 311 of the assembly 304 is inserted through the vent passage 303, the hood 309 is placed in covering relation to the high-intensity bulb 308, so that light emitted therefrom is diffused and reflected before exiting the housing 302. A "pal nut" or other appropriate fastener 315 is placed surrounding the sleeve 311 at the exterior of the housing 302.

BULB SOCKET/FILTER ASSEMBLY

Figure 14:
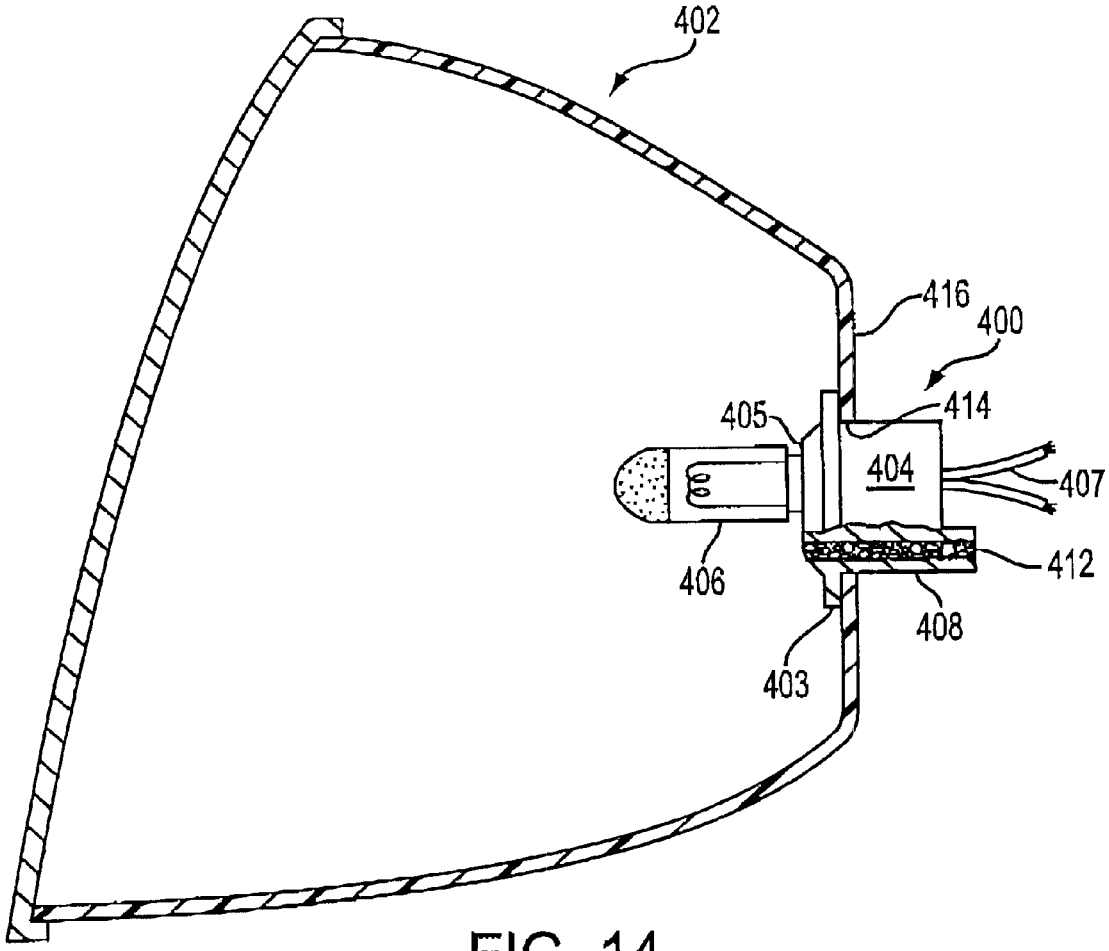
FIG. 14 is a partial cross section and a partial side plan view of a headlamp housing containing a fifth embodiment of the invention, wherein a desiccant filter is combined with a bulb socket.

Referring now to FIG. 14, a combination bulb socket and filter assembly in accordance with the invention is shown generally at 400, installed in a lamp housing 402. The assembly 400 includes a bulb socket 404, which is formed in generally conventional fashion, as a hollow cylindrical member with a recess 405 formed therein to receive the base portion of a bulb 406 therein, and electric wires 407 to provide power thereto.

The socket/filter assembly 400 further includes an integral filter sleeve 408 with a hollow passage 410 formed therethrough, and a nonwoven fiber mat 412 disposed within the passage 410 of the filter sleeve.

The lamp housing 402 has a cutout opening 414 formed through a back wall 416 thereof, and the socket/filter assembly 400 fits snugly therein. A transverse peripheral flange 403 may be provided extending around the assembly 400 to limit the travel thereof with respect to the back wall 416 of the housing 402.

STRUCTURE AND COMPOSITION OF THE FIBER MAT

Figure 15:
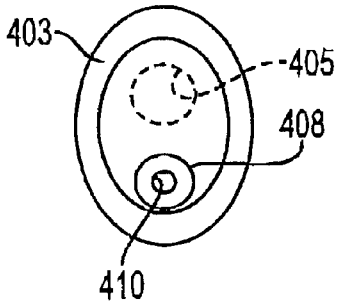
FIG. 15 is a rear plan view of the filter/bulb socket assembly of FIG. 14.

The fiber mat 112 of the second embodiment is shaped to fit inside of the container portion C' of the hollow body 111, but in all other respects, the fiber mat 112 is substantially identical to the fiber mat 12 of the first embodiment 10. Similarly, the fiber mat 212 of the shield/filter assembly in the embodiment of FIG. 11 is shaped to fit inside the passage 214 in the sleeve 211 thereof, but is otherwise identical to the fiber mat 12 of the first embodiment; and the fiber mat 412 of the bulb socket/filter assembly 400 of the embodiment of FIGS. 14–15 is shaped to fit inside the passage 410 in the sleeve 408 thereof, but is otherwise identical to the fiber mat 12 of the first embodiment.

Accordingly, it will be sufficient here to describe only the fiber mat 12 of the first embodiment, and it will be understood that this description also applies to the structure of the fiber mats 112, 212 of the second and third embodiments.

The fiber mat 12 includes a substrate made up of a plurality of flexible, nonwoven intermeshed wicking fibers 20 housed within the hollow body 11, and also includes a regenerable hygroscipic desiccant composition 18 distributed within the fiber substrate, as will be further described herein.

Figure 5:
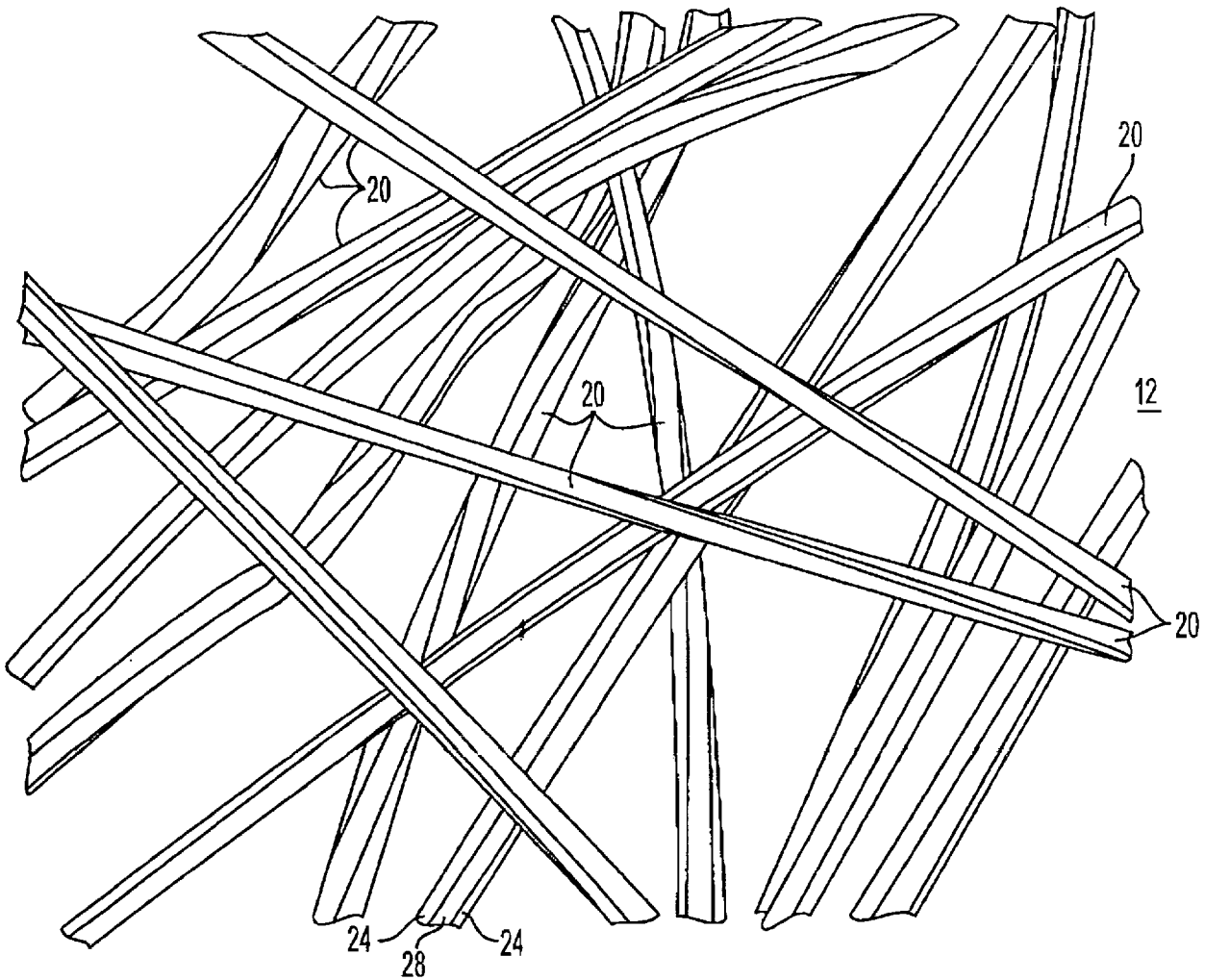
FIG. 5 is an enlarged perspective view of a portion of a fiber mat in accordance with the present invention.
Figure 6:
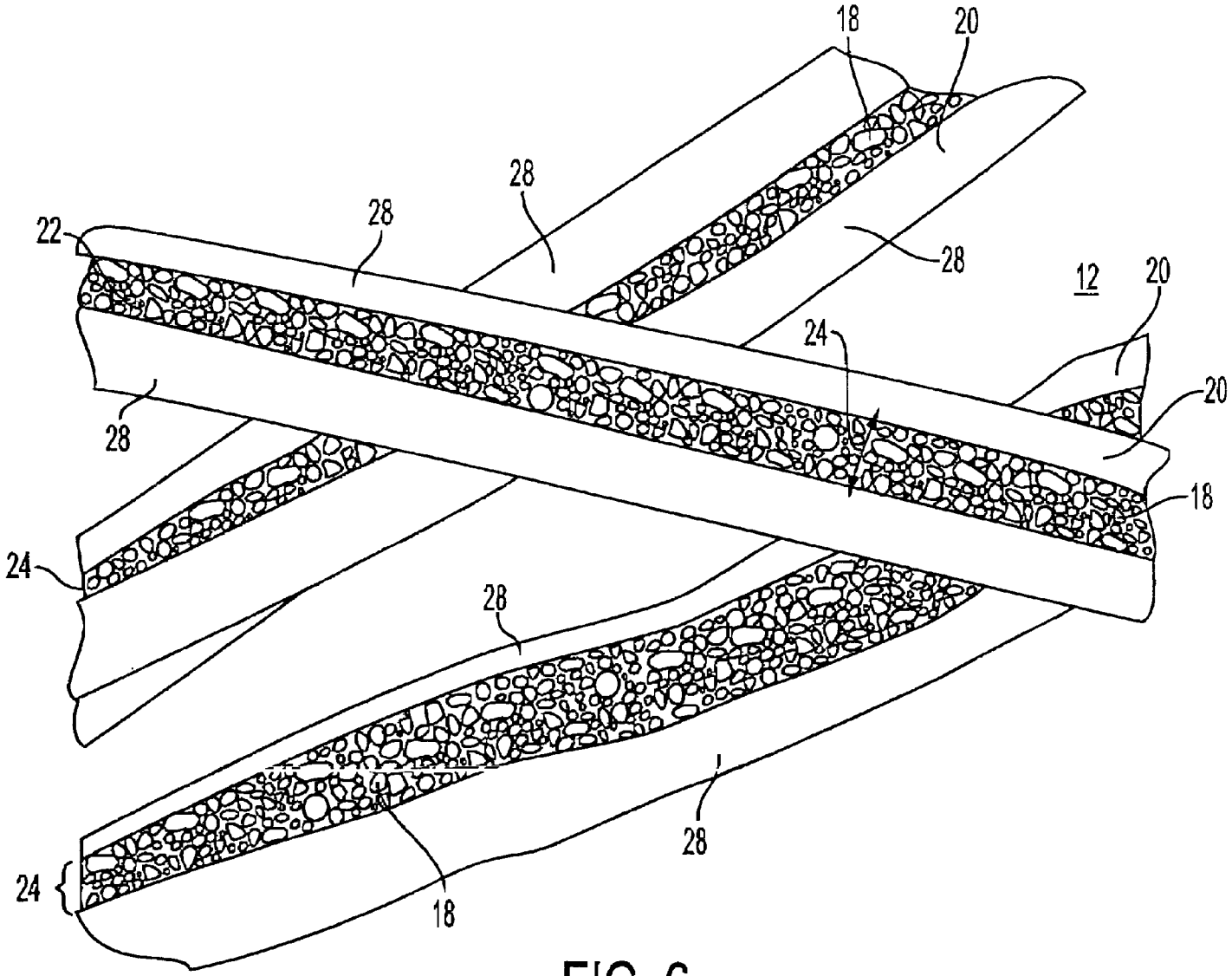
FIG. 6 is a further enlarged view of several of the elongated wicking fibers shown in FIG. 5, showing a hygroscopic liquid desiccant disposed within the longitudinally extending fiber cavities.

Referring to FIGS. 5 and 6, detail views of the fiber mat 12 are shown at increasing levels of magnification. The wicking fibers 20 are formed into the nonwoven fiber mat 12, which is used as a substrate carrier for the hygroscopic desiccant composition 18. The desiccant composition 18 is provided on the fibers 20 for removing water out of air flowing therepast.

The flexible fibers 20 are consistent with a general type of fiber described in U.S. Pat. No. 5,057,368 to Largman et al, the disclosure of which is hereby incorporated by reference. The Largman '368 reference discloses a fiber formed from thermoplastic polymers, wherein the fiber has a cross-sectional shape with a solid central core or stem, and three or four substantially T-shaped lobes 26 extending outwardly away from the central core. The legs of the lobes 26 intersect at the core, so that the angle between the legs of adjacent lobes is from about 80 degrees to 130 degrees. The thermoplastic polymer making up the fiber is typically a polyamide, a polyester, a polyolefin, a polysulfone, a fluoropolymer, any usable combination of these materials, or any other suitable thermoplastic which can be formed into the desired configuration.

A particularly preferred material for the fibers 20 of the present invention is polyethylene terephthalate, also referred to throughout the industry as PET.

The wicking fiber 20 is formed as an extruded strand, having the lobes extending radially outwardly from a central stem. The lobes are substantially T-shaped in cross-section, and cooperate to define hollow longitudinally extending interior cavities 22 therebetween, which house the hygroscopic desiccant composition 18 therein.

Figure 7:
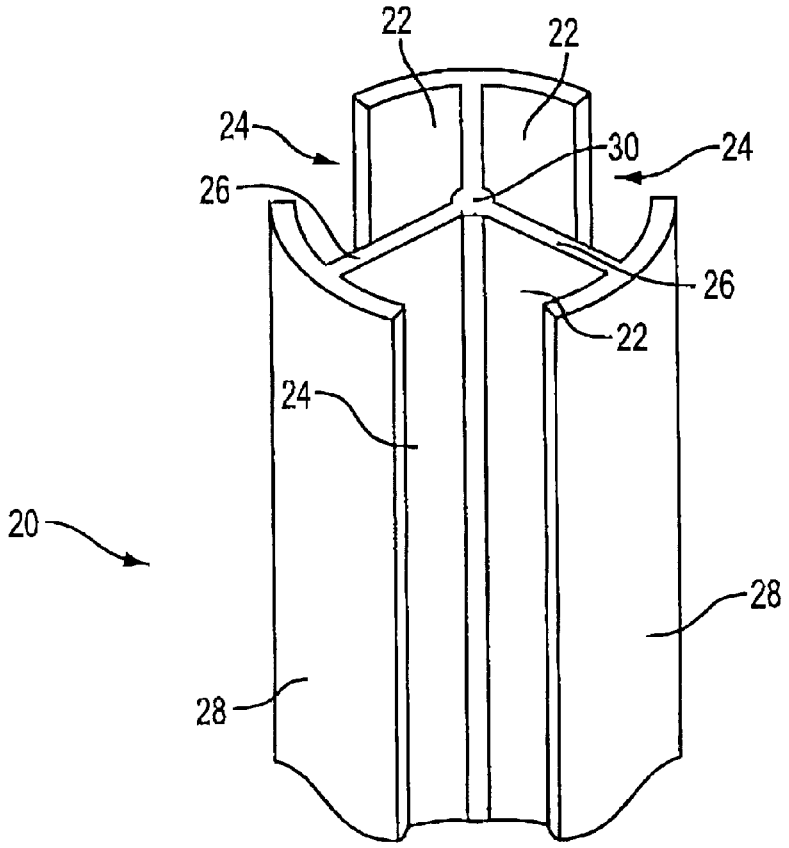
FIG. 7 is an end perspective view, partially cut away, of a first wicking fiber which is particularly suitable for practicing the present invention.

Referring now to FIGS. 6–7, a longitudinal opening or slot 24 extends, between adjacent lobes, from each cavity 22 to the surface of the respective fiber 20. The T-shaped lobes may have their outer surfaces 28 curved, as shown, or straight. While the wicking fiber is shown as having three lobes thereon, other numbers of lobes, such as two or four, may be used.

Figure 8:
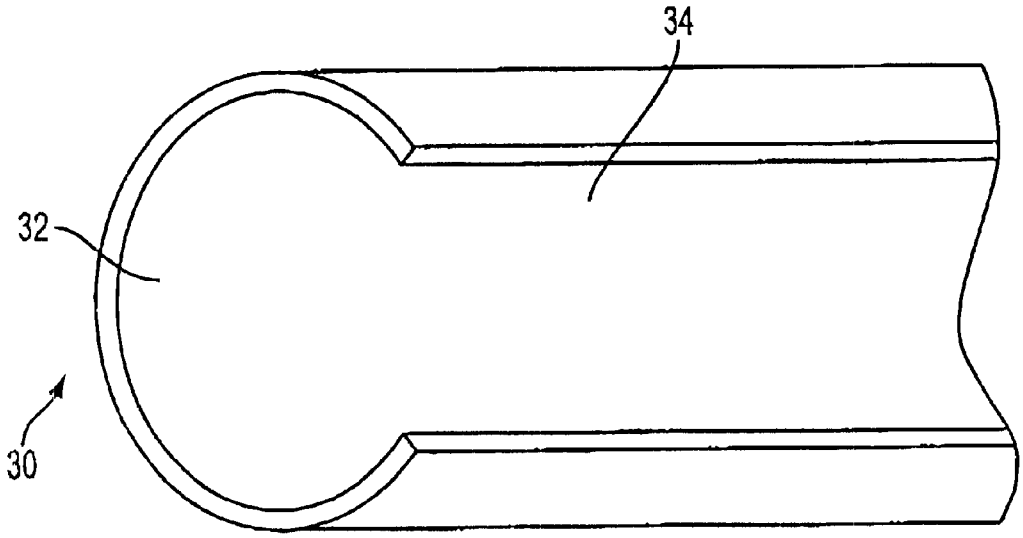
FIG. 8 is an end perspective view, partially cut away, of an alternative wicking fiber which is also usable in the practice of the invention.

In addition, other configurations of internal wicking fibers may be used. A C-shaped fiber 30, as shown in FIG. 8, or other cross-sectional shapes may be suitable for use in connection with the fiber mat of the present invention. The C-shaped fiber 30 is hollow and defines a longitudinally extending internal channel 32 therein, which is connected to the outer surface of the fiber by a longitudinally extending slot or opening 34. The hygroscopic desiccant composition 18 is held by capillary force within the longitudinally extending channels 32, and only comes into contact with air flowing through the mat 12 via the longitudinally extending slots 34.

The particular cross-sectional shape of the fibers 20 is not critical, so long as the shape selected includes one or more hollow internal channels for holding the desiccant material 18 therein, and a longitudinally extending slot to allow air passing the fibers to contact the desiccant via the slot.

The multi-lobed fibers 20 are relatively small, having a diameter in a range from about 250 microns to 10 microns or smaller. The fibers shown in FIGS. 1 and 2 are approximately 30 microns in diameter.

The preferred desiccant material, in the practice of the present invention, is a deliquescent liquid. The size of the opening 24 is selected so that when the desiccant liquid 18 is disposed in the cavity 22, it is retained therein. The capillary forces within the individual cavities 22 are so much greater than those external to the fiber 20 that the desiccant liquid 18 is readily wicked up the interior of the fiber 20, without appreciable wetting of the external surfaces 38 or filling up the internal voids between fibers. The fibers 20 may be pre-treated with a suitable surfactant to promote their ability to wick up the liquid 18. A preferred surfactant is that sold by the Atlas Powder Company under the trademark "TWEEN 20", although any suitable wetting agent known to those in the art may be used, provided it does not interfere with the function of the desiccant.

The fibers 20 strongly retain the liquid therein, through capillary action, so that the fiber mat 12 is not wet to the touch, and the liquid will not shake off. In a filter mat 12 of such wicking fibers 20 the area between the individual strands remains relatively free of the hygroscopic desiccant liquid 18 with which the internal cavities 22 of the fibers are filled.

It is particularly preferred in the practice of the present invention that a deliquescing liquid hygroscopic desiccant be used as the desiccant composition, preferably an alkali halide or an alkaline earth halide. Most preferably the desiccant composition is selected from the group consisting of lithium chloride, calcium chloride and magnesium chloride. These materials are preferred because they can absorb 400 percent or more of their weight in water. In contrast, solid adsorbents pick up 10–15 percent of their weight in water under favorable conditions. The preferred deliquescing salts are regenerable for multiple uses over time.

HALIDE SALT TEST

A comparative study was made of the deliquescing salts magnesium chloride, lithium chloride, and calcium chloride. In the first part of the test, anhydrous samples of each of the salts were first weighed and then placed in a chamber having 100% relative humidity in the air thereof The samples were allowed to equilibriate and were then re-weighed to determine the increase in weight from the anhydrous phase. The percent of weight gain is expressed as the weight of water gained, divided by the original weight of the salt, times 100.

After this second weight was concluded, the following weight gains were calculated from the observed weights before and after placement in the humidity chamber:

| Magnesium Chloride | Lithium Chloride | Calcium Chloride |
|---|---|---|
| 163% | 340% | 316% |

Subsequently, samples of the fully saturated desiccant salts were exposed to heated ovens in which the relative humidity in the air was ambient room humidity, at different temperatures and for different time periods, and in a final test, saturated samples were equilibriated at room temperature and at ambient relative humidity. After these soak periods in the different humidity levels, the samples were once again weighed and compared to the baseline weight of the respective anhydrous sample. In each case, the treated samples showed a weight gain due to associated water, but now showed a lower percentage of weight gain than they had exhibited previously after their soak in 100% relative humidity.

Table 1, below, summarizes the observed results of this study. In each case, the left hand column describes the environment of the salt, with RT representing ambient or room temperature, and R RH representing ambient or room relative humidity. The following columns list, by each salt tested, the percentage of weight gain of the salt as compared with the original anhydrous sample, expressed as the weight of water gained divided by the original weight of the salt, times 100. All of the values in Table 1 represent a decrease in water from the saturated samples listed above.

TABLE 1

| Environment | $MgCl_2$ | LiCl | $CaCl_2$ |
|---|---|---|---|
| R RH; 47° C. | 43% | 192% | 96% |
| R RH 53° C. (45 min) | 40% | 121% | 69% |
| R RH 53° C. (2 hr) | 37% | 98% | 66% |
| R RH 60° C. (.5 hr) | 32% | 90% | 65% |
| R RH 60° C. (20 hr) | 4.1% | 0 | — |
| 50% RH RT (20 hr) | 78% | 256% | 172% |

It is clear from a review of the data in Table 1 that while all of the salts showed effectiveness in absorbing water, and the ability to regenerate when heated, magnesium chloride shows the lowest percentage of associated water retained after regeneration, with calcium chloride and lithium chloride following.

SOLID VS. LIQUID DESICCANT PERFORMANCE COMPARISON

A comparison was made between a first foraminous tube filled with solid silica gel, and a substantially identical second foraminous tube filled with wicking fibers which were impregnated with liquid magnesium chloride as a desiccant, in accordance with the invention. In this experiment, the dry desiccant tubes were placed inside a vent tube of a headlamp housing similar to the housing H shown in FIG. 1. During this test, the housing H was equilibriated to 100 percent relative humidity therein, and was located inside of a sealed test chamber, in which the atmosphere outside of the housing H was also at 100 percent relative humidity.

The headlamp bulb was subjected to a complete on/off cycle, and the humidity inside of the lamp housing was monitored over time.

As shown by the graph of FIG. 9, the desiccant filter using wicking fibers and magnesium chloride, according to the invention, successfully reduced the level of humidity over time, under these worst-case conditions. By contrast, the solid silica gel desiccant was completely ineffective in reducing the humidity level in the test chamber.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

We claim:

1. An apparatus for dehydrating a vehicular lamp housing, comprising:

a hollow body defining a chamber therein, the hollow body having inlet and outlet openings formed therein in communication with the chamber, to allow air to flow from an area outside said hollow body into and through said chamber;

a substrate housed within said chamber of said hollow body;

a desiccant composition distributed on said substrate; and a bulb shield for partially blocking and diffusing light from a bulb in said housing, said bulb shield being operatively attached to said hollow body.

2. The apparatus of claim 1, wherein said bulb shield comprises a hood for placement in covering relation to a bulb, and a stem integrally and supportively connected to said hood, and further wherein said hollow body comprises a sleeve operatively attached to said stem.

3. The apparatus of claim 1, wherein the hollow body is a foraminous member having a plurality of openings formed therein.

4. The apparatus of claim 3, wherein the hollow body comprises a substantially cylindrical member.

5. The apparatus of claim 1, further comprising at least one porous membrane disposed across an opening of said hollow body.

6. The apparatus of claim 1, wherein said desiccant composition is a liquid.

7. The apparatus of claim 1, wherein said desiccant composition is selected from the group consisting of lithium chloride, calcium chloride and magnesium chloride.

8. An apparatus for dehydrating a vehicular lamp housing, comprising:

a hollow body defining a chamber therein, the hollow body having inlet and outlet openings formed therein in communication with the chamber, to allow air to flow from an area outside said hollow body into and through said chamber;

a substrate housed within said chamber of said hollow body, said substrate comprising a fiber mat made up of a plurality of nonwoven filaments, each of said filaments comprising an outer surface, a hollow internal cavity, and an extended opening whereby the hollow internal cavity communicates with the outer surface; and a desiccant composition distributed on said substrate.

9. The apparatus of claim 8, wherein each of said nonwoven filaments comprises a central stem and a plurality of substantially T-shaped lobes extending radially outwardly from the stem.

10. The apparatus of claim 8, wherein the substrate is formed from a material selected from the group consisting of polyamides, polyesters, polyolefins, polysulfones, fluoropolymers, and mixtures thereof.

11. The apparatus of claim 8, wherein said desiccant is disposed within said hollow internal cavities of said nonwoven filaments.

12. The apparatus of claim 8, wherein said desiccant composition is a liquid.

13. The apparatus of claim 8, wherein said desiccant composition is selected from the group consisting of lithium chloride, calcium chloride and magnesium chloride.

14. An apparatus for dehydrating a vehicular lamp housing, comprising:

a casing defining a chamber for supporting a substrate, the casing having at least one opening formed therein to allow air to flow from an area outside said casing across said substrate;

a substrate disposed in said chamber;

a desiccant composition distributed on said substrate, wherein said desiccant composition is selected from the group consisting of lithium chloride, calcium chloride and magnesium chloride; and a bulb shield for partially blocking and diffusing light exiting from a bulb in said housing, said casing being operatively attached to said bulb shield.

15. The apparatus of claim 14, wherein said casing comprises a foraminous member having a plurality of openings formed therein.

16. The apparatus of claim 14, wherein said casing comprises a substantially cylindrical member.

17. The apparatus of claim 14, wherein said casing comprises a hollow body, and further comprising at least one porous membrane disposed across an opening of said hollow body.

18. An apparatus for dehydrating a vehicular lamp housing, comprising:

a casing defining a chamber for supporting a substrate, the casing having at least one opening formed therein to allow air to flow from an area outside said casing across said substrate;

a substrate disposed in said chamber, said substrate comprising a fiber mat made up of a plurality of nonwoven filaments, each of said filaments comprising an outer surface, a hollow internal cavity, and an extended opening whereby the hollow internal cavity communicates with the outer surface; and a desiccant composition distributed on said substrate, wherein said desiccant composition is selected from the group consisting of lithium chloride, calcium chloride and magnesium chloride.

19. The apparatus of claim 18, wherein each of said nonwoven filaments comprises a central stem and a plurality of substantially T-shaped lobes extending radially outwardly from the stem.

20. The apparatus of claim 18, wherein the substrate is formed from a material selected from the group consisting of polyamides, polyesters, polyolefins, polysulfones, fluoropolymers, and mixtures thereof.

21. The apparatus of claim 18, wherein said desiccant is disposed within said hollow internal cavities of said nonwoven filaments.

22. An apparatus for dehydrating a vehicular lamp housing, comprising:

a hollow body defining a chamber therein, the hollow body formed as part of a bulb socket member having a recess formed therein to receive a light bulb and having inlet and outlet openings formed therein in communication with the chamber, to allow air to flow from an area outside said hollow body into and through said chamber;

a substrate housed within said chamber of said hollow body; and a desiccant composition distributed on said substrate.

* * * * *